United States Patent [19]

Brull

[11] Patent Number: 4,955,515

[45] Date of Patent: Sep. 11, 1990

[54] MAGNETIC THIMBLE

[76] Inventor: Kenneth J. Brull, 507 Dry Creek Cove, Round Rock, Tex. 78681

[21] Appl. No.: 369,520

[22] Filed: Jun. 12, 1989

[51] Int. Cl.[5] ..... D05B 91/04

[52] U.S. Cl. ..... 223/101; 2/21

[58] Field of Search ..... 223/101; 2/21

[56] References Cited

U.S. PATENT DOCUMENTS

| | | | |
|---|---|---|---|
| 43,100 | 6/1864 | Cox | 223/101 |
| 587,123 | 7/1897 | Holcomb | 223/101 |
| 926,040 | 6/1909 | Weigle | 223/101 |
| 1,301,093 | 4/1919 | Bradford . | |
| 2,207,672 | 7/1940 | Levey | 223/101 |
| 2,536,979 | 1/1951 | Furedi . | |
| 4,149,661 | 4/1979 | Curtiss . | |

*Primary Examiner*—Werner H. Schroeder
*Assistant Examiner*—Bibhu Mohanty
*Attorney, Agent, or Firm*—T. M. Gernstein

[57] ABSTRACT

A magnetic thimble includes an outer body and a magnetic liner that covers essentially the entire area of the outer body. One embodiment of the thimble also includes an extender so that the thimble can be used in areas and locations that the user's finger cannot reach.

6 Claims, 1 Drawing Sheet

MAGNETIC THIMBLE

TECHNICAL FIELD OF THE INVENTION

The present invention relates to the general art of finger and hand coverings, and to the particular field of thimbles.

BACKGROUND OF THE INVENTION

There are many small metallic objects, such as screws, nuts, pins and the like, found in the workplace and in the home. When such objects fall into difficult-to-reach places, retrieving them can be an onerous task. In fact, many such objects are simply left, and thus wasted, if dropped behind a bench, desk or the like

BACKGROUND ART

Since there are some objects which must be retrieved, the art contains several proposals for devices which aid in such retrieval. For example, thimbles, such as disclosed in U.S. Pat. Nos. 1,301,093, 2,536,979 and 4,149,661 are designed to aid such retrieval by including a magnet in one portion of a thimble.

While such thimble magnets are helpful, they have the drawbacks that they are not efficient at reaching objects that the tip of the user's finger cannot reach. This drawback becomes important if the object cannot be seen and the user is simply feeling around hoping to attract the object to the thimble. If the thimble tip on such devices is not exposed to the object, it is possible that the object will escape magnetic attraction to the Still further, these known thimbles are not successful in retrieving objects that are located in areas that the user's finger cannot reach, as behind another object, in a very small area, or the like. If the magnetic force from these known magnetic thimbles is not strong enough to reach the object, it is likely that it cannot be retrieved using such known thimbles.

Still further, many situations make it dangerous for a person to place his hands or fingers in certain areas. For example, if a small screw falls near a cutting machine, it is not advisable for someone to place their fingers in certain areas of that machine. Thus, thimbles which require the wearer's finger to be in the thimble may not be desirable.

Accordingly, the thimbles known to the inventor have drawbacks when it comes to retrieving an object that is not contacted or contactable by the tip of the user's finger.

Therefore, there is a need for a magnetic thimble that can retrieve objects without requiring the tip of the user's finger to contact or reach closely to the object being retrieved.

OBJECTS OF THE INVENTION

It is a main object of the present invention to provide a magnetic thimble that can retrieve objects without requiring the tip of the user's finger to contact or reach closely to the object being retrieved.

It is another object of the present invention to provide a magnetic thimble that can retrieve objects without requiring the tip of the user's finger to contact or reach closely to the object being retrieved and which can extend the user's reach into areas not accessible to his fingers.

SUMMARY OF THE INVENTION

These, and other, objects are achieved by a thimble that has an outer body and a magnetic liner that covers essentially the entire inner surface area of that outer body. Thus, magnetic force is associated not only with the tip of the wearer's finger, but with the area adjacent to the tip as well.

In this manner, the object can be retrieved even though the user's finger tip is not in contact with the object. The effective reach of the thimble is thus extended.

Still further, the thimble of the present invention includes an extender which permits the thimble to remain attached to the user's finger, and thus under the direct control of the user's finger, while being forced into an area not directly accessible to the user's finger. Thus, for example, the thimble can be forced into a small crevice or the like, and moved using the user's finger via the extender. This retains the advantages of the magnet thimble while permitting its reach to be extended into areas that would not be accessible to a thimble if that thimble were still on the user's finger.

DESCRIPTION OF THE DRAWING FIGURES

DETAILED DESCRIPTION OF THE PREFERRED EMBODIMENT OF THE INVENTION

Figure 1:
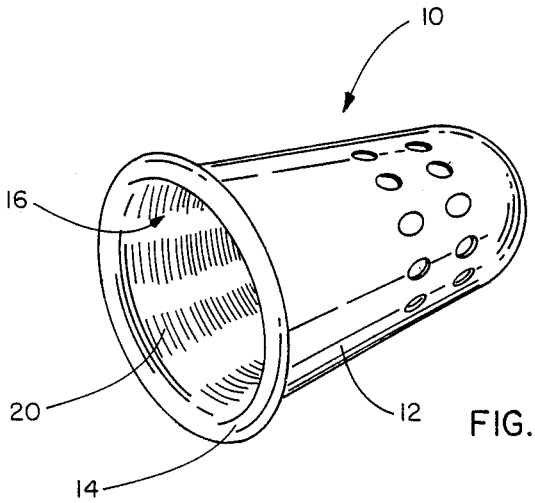
FIG. 1 is a bottom perspective view of the magnetic thimble embodying the present invention.
Figure 2:
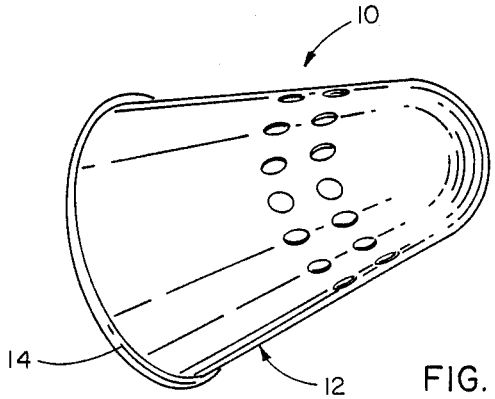
FIG. 2 is a top perspective view of the magnetic thimble embodying the present invention.

Shown in FIGS. 1 and 2 is a magnetic thimble 10 embodying the present invention. The thimble is worn on the fingertip of the user as is common to thimbles.

The thimble 10 includes an outer body 12 that is formed of flexible material, such as rubber or the like, and which has an inner surface that is located immediately adjacent to the fingertip of the wearer. A rim 14 is located on a lower portion of the thimble.

The thimble 10 includes a magnetic liner 16. The magnetic liner 16 covers essentially the entire surface area inside the thimble and contacts the wearer's fingertip. Preferably, such magnetic material includes ridges, such as ridge 20, for ensuring a non-slip grip of the thimble on the user's fingertip. The magnetic material preferably is flexible, such as found in some refrigerator magnets, so that it can be formed into a shape similar to that of the thimble whereby the thimble 10 can be comfortably worn on the fingertip of a user.

Figure 3:
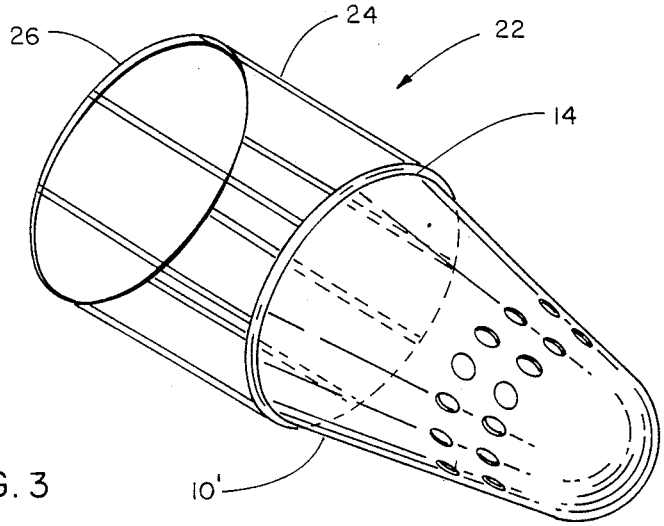
FIG. 3 is a top perspective view of the magnetic thimble embodying the present invention having an extender thereon.

As mentioned above, there are times when the thimble cannot be placed near enough to an object to retrieve such object when the user's finger is still in the thimble. In such an instance, the thimble 10' shown in FIG. 3 will be useful. The thimble 10' includes an outer body 12 and a ridged liner 16 similar to the thimble 10, but also includes an extender means 22 for extending the reach of such thimble beyond the areas that are directly accessible to the user's fingertip.

The extender means 22 includes a plurality of struts, such as strut 24, Which are formed of plastics-type material and each of which is connected at one end thereof to the rim 14. The struts extend downward from the rim 14, and a flexible band 26, such as a rubber band or other such elastomeric material, is affixed to the other ends of the struts. The band encircles the user's finger in the manner of a ring. The struts are long enough so that the band 26 is located to encircle the finger at a location spaced from the fingertip pad of the wearer. The band is sized to fit about the finger snugly enough to hold the thimble 10' in place by the force of the band 26 alone.

If an object to be retrieved is located in a small crevice, for example, the thimble 10' can be used to retrieve such object by moving the band 26 to a location near the fingertip and thus moving the thimble body away from the fingertip. The struts are plastic and thus are somewhat flexible so that the thimble body can be maneuvered by moving the fingertip. The thimble body is flexible so it can be compressed into a small area or crevice.

It is understood that while certain forms of the present invention have been illustrated and described herein, it is not to be limited to the specific forms or arrangements of parts described and shown.

I claim:

1. A thimble comprising:

(A) a flexible outer body having an inner surface; and (B) a magnetic liner attached to said outer body on said inner surface, said liner covering essentially the entire area of said inner surface.

2. The thimble defined in claim 1 further including an extender means connected to said outer body.

3. The thimble defined in claim 2 wherein said outer body includes a rim and said extender means is connected to said rim.

4. The thimble defined in claim 3 wherein said extender means includes a plurality of flexible struts and an elastomeric band.

5. The thimble defined in claim 4 wherein said struts are each connected at one end thereof to said rim and at another end thereof to said band.

6. The thimble defined in claim 5 further including ridges on said magnetic liner.

* * * * *